US006464420B2

(12) United States Patent
Brunetti

(10) Patent No.: US 6,464,420 B2
(45) Date of Patent: Oct. 15, 2002

(54) LIQUID INK WRITING PEN WITH VISIBLE TIP

(75) Inventor: Bruce W. Brunetti, Phillipsburg, NJ (US)

(73) Assignee: Chartpak, Inc., Leeds, MA (US)

( * ) Notice: Subject to any disclaimer, the term of this patent is extended or adjusted under 35 U.S.C. 154(b) by 0 days.

(21) Appl. No.: 09/821,471

(22) Filed: Mar. 29, 2001

(65) Prior Publication Data

US 2002/0141808 A1 Oct. 3, 2002

(51) Int. Cl.[7] ..... B43K 7/02
(52) U.S. Cl. ..... 401/202; 401/213; 401/217
(58) Field of Search ..... 401/199, 202, 401/209, 213, 217, 243, 247

(56) References Cited

U.S. PATENT DOCUMENTS

| | | | | |
|---|---|---|---|---|
| 3,947,137 | A | | 3/1976 | Hori |
| 3,951,555 | A | * | 4/1976 | Wittnebert et al. ..... 401/217 |
| 4,239,408 | A | | 12/1980 | Mutschler |
| 4,302,121 | A | | 11/1981 | Kim |
| 4,382,707 | A | | 5/1983 | Anderka |
| 4,548,325 | A | | 10/1985 | Hojer et al. |
| 4,558,966 | A | | 12/1985 | Mikuteit |
| 4,671,692 | A | | 6/1987 | Inaba |
| 4,712,937 | A | | 12/1987 | Schmidt et al. |
| 4,753,546 | A | | 6/1988 | Witz et al. |
| D305,245 | S | | 12/1989 | Chuang |
| 4,930,921 | A | | 6/1990 | Anderka |
| 5,154,526 | A | * | 10/1992 | Bothe ..... 401/258 |
| 5,336,009 | A | | 8/1994 | Young |
| D363,308 | S | | 10/1995 | Sekine |
| D373,383 | S | | 9/1996 | Izushima |
| D387,803 | S | | 12/1997 | Izushima |
| D391,294 | S | | 2/1998 | Izushima |
| 5,829,904 | A | | 11/1998 | Matsumoto et al. |
| 5,927,886 | A | | 7/1999 | Matsumoto et al. |
| 5,938,362 | A | | 8/1999 | Bastiansen |
| D425,124 | S | | 5/2000 | Chen |
| 6,062,758 | A | | 5/2000 | Maurer et al. |
| 6,261,019 | B1 | | 7/2001 | Furukawa |

* cited by examiner

*Primary Examiner*—David J. Walczak
*Assistant Examiner*—Peter deVore
(74) *Attorney, Agent, or Firm*—Schweitzer Cornman Gross & Bondell LLP

(57) ABSTRACT

A writing pen of the type employing low viscosity liquid ink retained in a reservoir in the pen body by means of a capillary collector element. The nib of the patent is color coded to correspond with the color of ink contained within the pen. A closure cap for the pen is formed with large openings in the region surrounding the color coded nib, to provide visual access to the colored nib when the cap is mounted on the pen body. An air passage, necessary for the reservoir of the pen to "breath", is extended to have its outlet immediately adjacent the writing tip of the pen, and the closure cap is provided with an internal sealing cup at its closed end, which is received over the writing tip and closely adjacent portions of the nib, to seal both the writing tip and the air passage, when the closure cap is in place. The color coded nib is formed by a colored sleeve, which is positioned over the projecting nib of the pen and defines one or more passages for breathing air, leading from the tip of the pen back to the capillary cartridge.

12 Claims, 3 Drawing Sheets

LIQUID INK WRITING PEN WITH VISIBLE TIP

RELATED APPLICATIONS

This application is related to the invention of my co-pending application Ser. No. 09/711,184, filed Nov. 13, 2000. It is advantageously, although by no means necessarily, utilized in conjunction with features of that co-pending application.

BACKGROUND OF THE INVENTION

The present invention relates to writing pens and more particularly to writing pens utilizing relatively low viscosity liquid inks particularly, but not necessarily, for stylus or ballpoint pens. Writing pens of this general type, utilizing low viscosity liquid inks, are preferred for many applications over older style ballpoint pens, for example, which utilize a high viscosity ink. The low viscosity inks provide for a much smoother writing action and a more intense written line than the high viscosity inks. When using low viscosity inks, however, special provisions must be made to prevent leakage of the ink and/or to properly control the flow of ink during writing. A generally preferred form of inexpensive pens for this purpose utilizes a so-called vacuum reservoir for the liquid ink in conjunction with a capillary collector that enables ink to be fed to the writing tip and also enables the reservoir to "breathe" in response to the consumption of ink and/or to changes in temperature and pressure. The general principles of such pens are well known as set forth in, for example, the Wittnebert U.S. Pat. No. 3,951,555.

The present invention provides a writing pen of the general type described above, which can be economically produced and which has superior writing characteristics. More particularly, the invention is directed to a type of writing pen, usually but not necessarily non-refillable, in which an ink reservoir is formed by the main body of the pen. The body is preferably formed of a molded plastic material, closed at one end and open at the other. The open end of the pen body is closed by a collector cartridge, provided with a plurality of closely spaced circular fins or lamellae and capillary passages. A writing element, preferably but not necessarily a ballpoint tip, is mounted at the lower end of the collector cartridge and is provided with a capillary rod which extends into a central through passage in the collector cartridge and thus communicates directly with the ink supply contained in the pen body reservoir, above the collector cartridge.

In pens of the type described above, as ink is consumed from the reservoir, it is replaced by air drawn in through the collector cartridge. Additionally, both the ink in the reservoir and the air above the ink are influenced by changes in temperature and barometric pressure. Accordingly and in accordance with known principles of such pens, the reservoir is associated with a "breathing" passage defined by the multiple lamellae of the collector cartridge, and predetermined passages therein which serve to retain the liquid ink against outflow, by reason of capillary action, while accommodating the inward and outward flows of air required as a result of temperature and pressure changes and consumption of ink through the writing tip of the pen. The passage or passages for such airflow terminate near the lower end of the pen, typically in the region where the writing tip assembly joins with the pen body. With this arrangement, the breathing passage is open to the atmosphere, while the pen is in active use. When the cap of the pen is replaced after use, the airflow passage is effectively closed, so that the ink within the pen is not prematurely dried out.

It is contemplated that the new pen will be furnished with inks of various colors, usually in sets suitable for artists, etc. To this end, the pen advantageously is provided with a nib which is color coded to indicate the color of the ink contained within the pen. Additionally and significantly, it is desired to provide the pen with a novel form of cap which, in the region of the colored nib, is formed with large openings which fully expose the colored nib and enable the artist to quickly ascertain the pen's color without removing the cap or looking through a window of plastic material. The pen body and cap may be made out of a material of common color (e.g., black) to achieve economies of manufacture, while at the same time enabling the user to instantly ascertain the ink color by simply viewing the nib through the large openings in the cap.

One of the problems inherent in the use of a cap as contemplated, which is formed with large viewing openings therein, is that when the cap is placed on the end of the pen after use, it does not close and seal the terminal end of the breathing passage as typically constituted and located. Over time, this could result in premature drying and degradation of the ink contained within the pen.

SUMMARY OF THE INVENTION

Pursuant to the invention, a novel arrangement is provided for a multi-color pen system, including a color-coded nib structure and a cap with large openings, in which the breathing passage for the pen is routed through the nib, to a point closely adjacent to the writing point. Additionally, the cap is constructed to provide an outer end portion of closed configuration joined by relatively thin, axially extending connecting elements to a mounting collar, by which the cap is mounted on the pen body and which define large viewing openings in the cap. Internally, the closed end of the cap is provided with a sealing cup which, when the cap is applied to the pen body, receives the writing point of the pen, and closes and seals the breathing passage which terminates immediately adjacent thereto. The cap thus provides for the desired highly open structure within the region of the color coded nib, yet at the same time functions to seal both the writing tip and the breathing passage of the pen, when the cap is applied to the pen body, to prevent premature degradation of the ink supply.

Other features and advantages of the invention will become apparent upon consideration of the following detailed description of a preferred embodiment and by reference to the associated drawing and the appended claims.

DESCRIPTION OF PREFERRED EMBODIMENT

Figure 1:
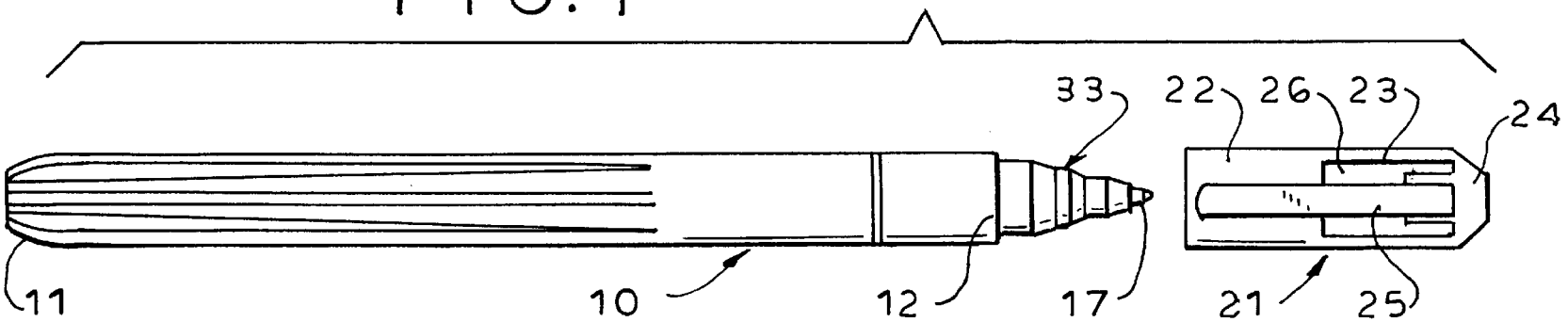
FIG. 1 is an exploded elevational view showing a preferred form of writing pen according to the invention.
Figure 6:
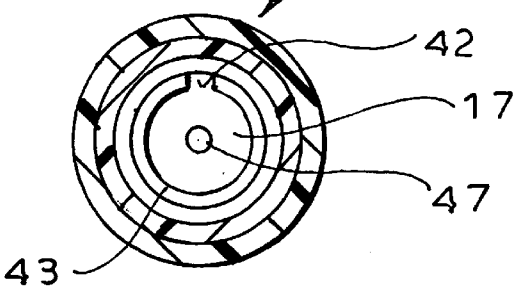
FIGS. 4, 5 and 6 are cross sectional views as taken generally on lines 4—4, 5—5 and 6—6 respectively of FIG. 3.
Figure 5:
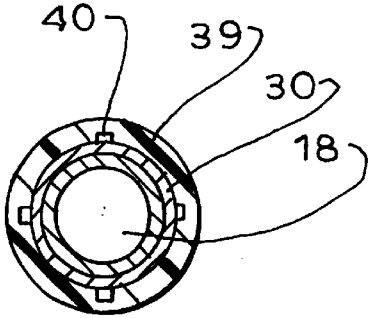
Figure 4:
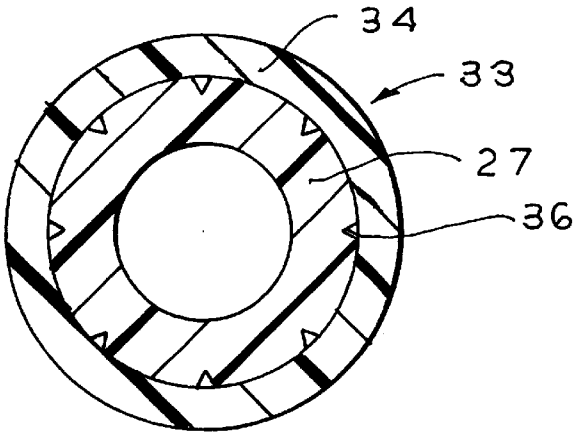

Referring now to the drawing, the reference numeral 10 designates generally a pen body typically molded of a rigid plastic material and having a closed end 11 and an open end 12. The open end 12 communicates with a hollow interior 13 of the pen body, which forms a reservoir for low viscosity liquid ink. A combination nib and collector cartridge 14 (FIG. 2) is inserted into the open end 12 of the pen body, such that the collector cartridge 15 (which has considerably greater axial length than is illustrated in the drawings) is snugly received within the hollow interior of the pen body. The nib portion 16 of the cartridge extends beyond the open end of the pen body and mounts a writing tip 17 at its outer end extremity. The writing tip 17, in accordance with known principles, is associated with a capillary element (not shown) which extends through an internal passage 18 in the nib 16 and collector cartridge 15 and is exposed to the ink supply in the upper portion of the internal reservoir cavity 13. Also in accordance with known principles, the collector cartridge 15 serves generally to seal off the lower end of the reservoir cavity 13, while providing capillary passages between individual lamellae 19 of the cartridge, and in appropriately positioned axial capillary passages 20, to accommodate the necessary inflow and outflow of air into and out of the reservoir to replace ink consumed during use of the pen and to accommodate variations in the ambient.

In accordance with one of the important features of the invention, the nib area of the pen is color coded to correspond to the color of ink contained within the pen. Accordingly, the user of the pen need only to glance at the nib area of the pen to make an appropriate color selection. Significantly, it is desired that the color-coding of the nib area be visible to the user when the pen is covered by a cap, which is desired when the pen is not in use. To this end, the pen includes a cap structure which is largely open in the area of the color-coded nib, allowing the user to quickly determine the color of the pen even when the cap is in its closed position.

Figure 2:
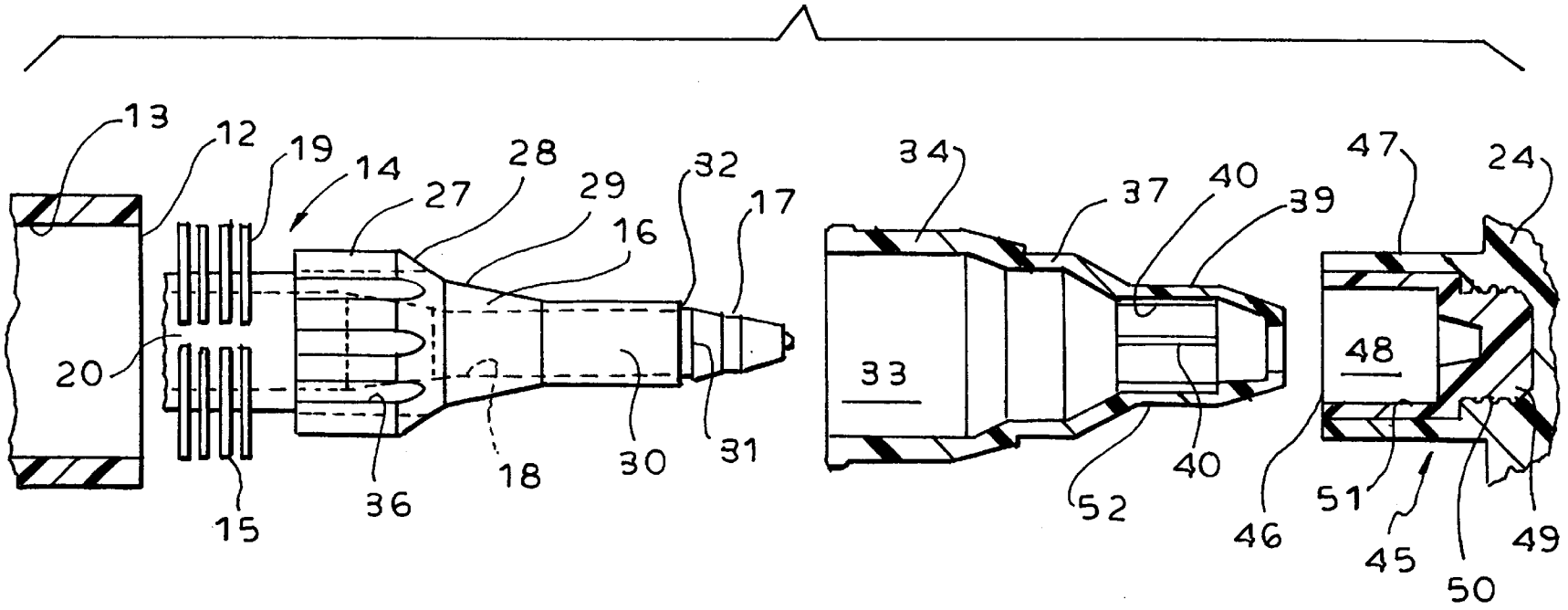
FIG. 2 is an enlarged, fragmentary exploded view showing details of the nib and cap structure of the pen of FIG. 1.

With reference particularly to FIGS. 1 and 2, a cap 21 is comprised of a mounting collar 22, a plurality of longitudinally extending connecting elements 23, and a closed end portion 24. The mounting collar 22 and closed end 24 are integrally joined by the longitudinal connecting elements 23 to provide a rigid cap structure. A clip 25 typically is provided to enable the end to be clipped to a shirt pocket, for example, if desired. In a preferred form of the invention, the length of the connecting elements is substantial, for example in the order of 0.75 inch in a cap of approximately ½ inch diameter. The connecting elements 23 are relatively narrow in comparison to the diameter of the cap, for example, approximately 0.1 inch for a cap of approximately ½ inch in diameter. As a result, the connecting elements 23 define large open window areas 26 to provide high visibility to the interior of the pen cap 21, enabling the color coded nib area to be easily viewed when the cap is in a closed position, mounted at the open end of the pen body, as reflected in FIG. 3.

Figure 3:
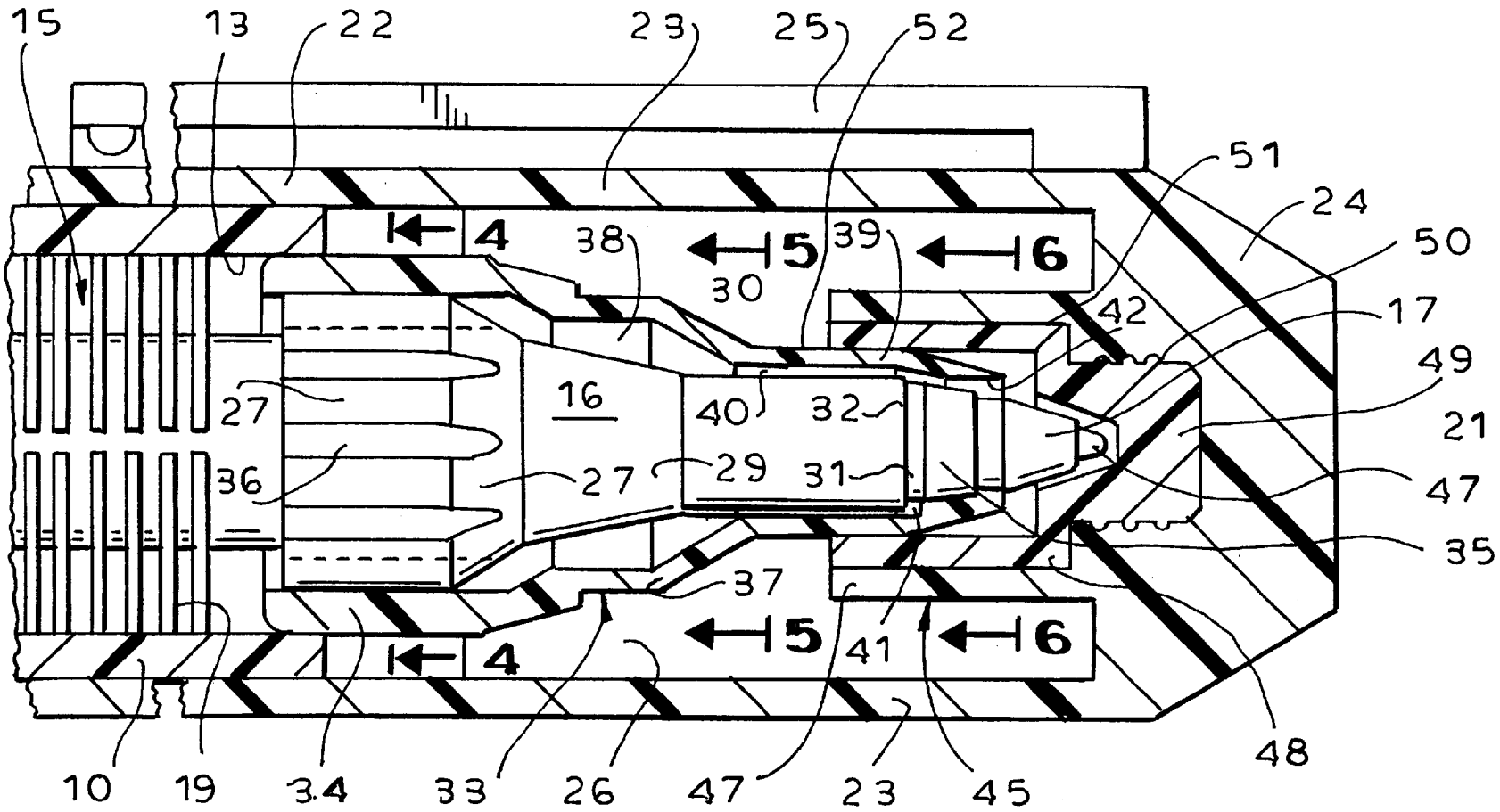
FIG. 3 is a fragmentary longitudinal cross sectional view showing the structural elements of FIG. 2 in fully assembled configuration.

In a preferred form of the invention, and as shown particularly in FIG. 3, the unitary capillary cartridge and nib assembly is inserted into the open end of the pen body 10 to a point at which the entire cartridge 15, and preferably a portion of the upper end of the nib 16 are within a lower portion of the reservoir cavity 13. The upper end 27 of the nib, a portion of which is received within the cavity 13, has an outside diameter less than the inside diameter of the reservoir cavity 13, providing an annular clearance space between those members. Below its upper portion 27, the nib is formed with tapered sections 28, 29 joining a cylindrical sealing section 30. The writing point 17 is received within the nib, and a shoulder 31 thereof seats against the lower end 32 of the cylindrical sealing portion 30.

Pursuant to the invention, a color-coded sleeve 33, colored to match the ink contained in the reservoir cavity 13 above the capillary cartridge 15, surrounds and substantially encloses the nib 16 and forms an active part of the nib assembly. As shown in FIG. 3, the upper end 34 of the color-coded sleeve 33 fits tightly over the upper end 27 of the nib, and also tightly within the reservoir cavity 13, forming a tight seal between the nib assembly and the pen body 10. The color-coded sleeve 33, which is of tapered configuration, extends over the nib 16 up to a point closely adjacent to the end of the writing tip 17, partially surrounding the upper portions 35 of the writing tip. As is evident in FIG. 3, the color-coded sleeve 33 is easily visible through the large openings 26 in the closure cap, so that the color of the ink contained within the pen is readily identified whether or not the closure cap is in place.

In typical pen construction, the necessary "breathing" of the pen is accommodated by providing a breathing aperture in the vicinity of the end of the pen body 10. This is suitable for pens of more conventional construction, because the breathing apertures are sealed, along with the writing tip of the pen, when a conventional, fully closed cap is placed over the pen body. In the pen of the illustrated form, however, which includes a color-coded nib structure and an open cap configuration, a breathing aperture thus conventionally located would not be sealed when the cap is applied to the pen body. In the pen of the present invention, breathing of the pen while in use, and complete sealing when not in use, is accommodated by providing passages for breathing air within the regions confined by the color-coded sleeve 33, exiting immediately adjacent to the writing tip, at a location where it may be sealed without interfering with the visibility of the color-coded sleeve when the cap is placed on the pen.

As shown in FIG. 3, the upper end 27 of the nib is provided with a plurality of longitudinally aligned grooves 36 which extend from the upper end extremity of the nib into the area of the first tapered reduction 28. This provides for airflow communication from a point above the nib to an area at the lower ends of the grooves 36. In the region between the upper end 27 of the nib and the cylindrical sealing portion 30 thereof, the color-coded sleeve 33 is formed with a portion 37 of tapered configuration. However, the internal dimensions of the sleeve 33 are greater than the external dimensioins of the nib at the same section, forming an annular space 38 communicating with the several longitudinal grooves 36.

In the region of the cylindrical sealing portion 30 of the nib, the color-coded sleeve 33 is formed with a mating cylindrical sealing portion 39. This last mentioned portion 39 preferably fits tightly over the cylindrical portion 30 of the nib, but is provided with a plurality of angularly spaced longitudinal grooves 40 which extends from the annular chamber 38, at their upper ends, to a second annular chamber 41, at their lower ends. The annular chamber 41 in turn connects with an inlet/outlet opening 42 at the end of the sleeve, closely adjacent to the end of the writing tip 17. The necessary breathing of the pen is thus provided through the opening 42 and the various passages internally of the color-coded sleeve 33, into the reservoir area of the pen. The lowermost end portion 43 of the sleeve 33, beyond the sealing portion 39, is tapered further to closely surround upper portions of the writing tip 17, except in the area of the opening 42. The sleeve 33 advantageously is formed of a plastic material, such as polypropylene, which has excellent water vapor barrier characteristics.

In order to fully seal the writing tip 17 and the breathing outlet 42 when the pen is closed, the cap 21 is provided with a cylindrical closure assembly 45 extending axially from its closed end 24 and having an open end 46 (FIG. 2) arranged to be received over the cylindrical portion 39 of the color-coded sleeve, in snug fitting, sealing relationship. As will be evident in FIG. 3, when the closure cap 21 is applied over the end of the pen, both the writing tip 17, including its writing ball 47, and the outlet opening 42 of the breathing system are enclosed by the cylindrical closure 45 such that the interior of the pen is completely sealed. At the same time, the cylindrical closure covers only a small portion of the color-coded sleeve 33, with the majority of the sleeve, and particularly the larger diameter portions thereof, being highly visible for easy color selection by the user. The cylindrical closure assembly does not need to cover the entire cylindrical portion 39 of the sleeve, but only so much thereof as is required to effect a good seal.

For most purposes, it is advantageous to form the closure cap 21 of relatively rigid plastic material for structural soundness. Accordingly, in the illustrated form of the invention, the closure assembly 45 is comprised of an outer cylinder 47, which is integral with the end portion 24 and is formed of the same material as the remainder of the cap 21. Received inside the cylindrical wall 47 is a sealing cup 48, formed of a softer plastic material, preferably polypropylene which has excellent water vapor barrier characteristics and thus functions as a good sealing material. The sealing cup advantageously is formed with an end boss 49, which is press fitted into a recess 50 in the end portion 24 of the cap to lock the sealing cup in position. The inner cylindrical walls 51 of the sealing cup are dimensioned to fit with a snug, interference fit with the outer surfaces 52 of the cylindrical sealing portion 39 of the color-coded sleeve 33, as is evident in FIG. 3. The overall arrangement is relatively simple and economical to manufacture, yet provides highly effective sealing of the pen, as desired.

The unique structure of the described pen enables a color-coded nib structure to be utilized, in conjunction with an open closure cap, in a manner that enables the user to easily determine the ink color of the pen, whether the closure cap is in place or removed. The special nib structure of the new pen, including a separate color coded sleeve which is fitted over the nib of the pen enables the breathing outlet of the pen to be relocated or rerouted to the tip portion of the pen, immediately adjacent to the end of the writing tip. The closure cap for the pen, while providing a maximized open area between the mounting collar and end portion of the cap, nevertheless provides for highly effective sealing of the pen, by means of a cylindrical sealing assembly extending actually from the end portion of the cap and snugly surrounding and sealing an end portion of the color coded sleeve, adjacent to but above the writing tip and air inlet/outlet opening.

In should be understood, of course, that the specific forms of the invention herein illustrated and described are intended to be representative only, as certain changes may be made therein without departing from the clear teachings of the disclosure.

I claim:

1. A liquid ink pen which comprises, (a) an elongated pen body having a hollow interior portion and an open lower end, (b) said pen body containing a reservoir for liquid ink communicating with said open end, (c) a nib mounted adjacent the open end of said pen body and extending a distance therefrom, (d) said nib mounting a writing tip at a lower end thereof, (e) a capillary element communicating with said reservoir and having passage forming elements for the flow of writing ink from said reservoir to said writing tip and having capillary passages to accommodate the flow of breathing air to and from said reservoir, and (f) a color coded sleeve surrounding said nib, (g) an internal passage for beathing air formed by one or both of said sleeve and nib, (h) said internal passage communicating at one end with said capillary passages and communicating at an outlet end with the atmosphere, (i) said outlet end of said internal passage being located adjacent a lower end extremity of said sleeve, closely adjacent said writing tip.

2. A liquid ink pen according to claim 1, wherein (a) a removable closure cap is receivable in sealing relation over said writing tip, said lower end extremity of said sleeve, and the outlet end of said internal passage while substantially exposing said color coded sleeve.

3. A liquid ink pen according to claim 2, wherein (a) said closure cap comprises a mounting collar receivable snugly over said pen body, (b) a plurality of angularly spaced apart spacer elements integral with said mounting collar extend longitudinally therefrom, and define open spaces therebetween exposing said color coded sleeve, (c) said closure cap has an end cap portion integrally joined with said spacer elements, and (d) said closure cap has a sealing portion enclosing said writing tip and said outlet end of said internal passage.

4. A liquid ink pen according to claim 3, wherein (a) the end portion of said cap includes a socket element extending toward said writing tip and said outlet end, and (b) a sealing cup of plastic material is received in said socket element and surrounds and seals said writing tip and said outlet end.

5. A liquid ink pen according to claim 4, wherein (a) said closure cap is formed principally of a relatively hard and rigid plastic material, and (b) said sealing cup is formed of a relatively softer plastic material which is positioned within said socket and is formed with a recess for the reception of said writing tip and portions of said color coded sleeve defining said outlet.

6. A liquid ink pen according to claim 5, wherein (a) said color coded sleeve and said sealing cup are formed of polypropylene.

7. A liquid ink pen according to claim 1, wherein (a) said color coded sleeve has an upper end portion received in snug fitting relation over upper portions of said nib, (b) said upper end portion of said sleeve also is received in snug fitting relation within the open end of said pen body, and (c) one of s aid sleeve or nib has air flow grooves therein for the controlled passage of air to and from said reservoir.

8. A liquid ink pen according to claim 7, wherein (a) a lower end portion of said color coded sleeve is received in snug fitting relation to said lower end of said nib, and (b) one of said lower portion of said sleeve and said lower portion of said nib is formed with grooves therein for the controlled passage of air to and from said reservoir.

9. A liquid ink pen which comprises, (a) an elongated pen body having a hollow interior portion and an open lower end, (b) said pen body containing a reservoir for liquid ink communicating with said open end, (c) a collector element received in said open end and providing a seal against the uncontrolled flow of ink from said reservoir, (d) said collector element comprising a plurality of closely spaced lamellae and passages for the axial flow of air into and out of said reservoir, (e) said collector element having a nib portion at an outer end thereof and having a principal passage extending through said nib portion for the outflow of ink, (f) a writing point mounted at an outer end of said nib portion and communicating with said principal passage, (g) a color coded sealing sleeve received over said nib portion and extending from said pen body substantially to said writing tip, (h) said sealing sleeve being sealingly associated with the open end of said pen body and with a lower end portion of said nib portion, (i) elements of said sealing sleeve and said nib portion forming an axially extending breathing passage opening closely adjacent said writing tip and extending toward said reservoir, (j) said breathing passage communicating with said passages in said collector element to accommodate the flow of air to and from said reservoir.

10. A liquid ink pen according to claim 9, wherein (a) a sealing cup has a portion removably receivable over said writing tip and said opening of said breathing passage, and (b) the portion of said sealing cup receivable over said writing tip and opening being of substantially shorter length than said color coded sleeve, whereby major portions of said sleeve are visible above said sealing cup when said cup in received over said tip and passage.

11. A liquid ink pen which comprises, (a) an elongated pen body having a hollow interior portion and an open lower end, (b) said pen body containing a reservoir for liquid ink communicating with said open end, (c) a nib mounted adjacent the open end of said pen body and mounting a writing tip at a lower end thereof, (d) a capillary element communicating with said reservoir and having passage forming elements for the flow of writing ink from said reservoir to said writing tip and having capillary passages to accommodate the flow of breathing air to and from said reservoir, (e) a color coded sleeve surrounding said nib and defining an internal passage for breathing air, (f) said internal passage communicating at one end with said capillary passages and at an outlet end closely adjacent said writing tip with the atmosphere, (g) said color coded sleeve having an upper end portion received in snug fitting relation over upper portions of said nib, (h) said upper end portion of said sleeve also being received in snug fitting relation within the open end of said pen body, and (i) one of said sleeve or nib having air flow grooves therein for the controlled passage of air to and from said reservoir.

12. A liquid ink pen according to claim 11, wherein (a) a lower end portion of said color coded sleeve is received in snug fitting relation to said lower end of said nib, and (b) one of said lower portion of said sleeve and said lower portion of said nib is formed with grooves therein for the controlled passage of air to and from said reservoir.

* * * * *